United States Patent [19]

Renstrom

[11] Patent Number: 4,767,653

[45] Date of Patent: Aug. 30, 1988

[54] SPLICEABLE SHEET MATERIAL

[75] Inventor: Richard L. Renstrom, South St. Paul, Minn.

[73] Assignee: Minnesota Mining and Manufacturing Company, Saint Paul, Minn.

[21] Appl. No.: 796,702

[22] Filed: Nov. 12, 1985

Related U.S. Application Data

[62] Division of Ser. No. 592,620, Mar. 23, 1984, abandoned.

[51] Int. Cl.[4] ..... B32B 3/06

[52] U.S. Cl. ..... 428/40; 52/409; 52/411; 428/57; 428/192; 428/194; 428/200; 428/334; 428/346; 428/347; 428/349; 428/355; 428/516; 428/517; 428/519; 428/520; 428/522

[58] Field of Search ..... 428/57, 194, 522, 40, 428/516, 346, 347, 349, 200, 308.4, 334, 489, 355, 192, 517, 519, 520; 156/218, 306.6; 52/409, 411

[56] References Cited

U.S. PATENT DOCUMENTS

| | | | |
|---|---|---|---|
| 3,650,874 | 3/1972 | Job et al. | 161/217 |
| 4,404,249 | 9/1983 | Margerum et al. | 428/483 |
| 4,416,944 | 11/1983 | Adur | 428/355 |
| 4,421,807 | 12/1983 | Clausing et al. | 428/489 |

FOREIGN PATENT DOCUMENTS

| | | |
|---|---|---|
| 48003 | 3/1980 | European Pat. Off. . |
| 1382826 | 1/1975 | United Kingdom . |

OTHER PUBLICATIONS

Polysar Progress, Sep.-Oct., 1983, pp. 1, 4.

VersiGard Roofing Systems by Goodyear Tire & Rubber Company, Brochure No. 821-620-080.

*Primary Examiner*—John E. Kittle

*Assistant Examiner*—P. R. Schwartz

*Attorney, Agent, or Firm*—Donald M. Sell; Richard E. Brink

[57] ABSTRACT

Heat-sealable sheet material for use in the fabrication of lapped-seam membrane. In a presently preferred construction, linear low density polyethylene film is adhered to one lateral border of cured polymerized EPDM composition; preferably the adhesive is protected with a removable liner, e.g., a polyester film until lapped-seam splicing is to be carried out. A transfer tape based on thermoplastic heat-sealable adhesive carried by a strippable liner also constitute part of the invention. The transfer tape is advantageously applied to a sheet of uncured EPDM compound and the resultant assembly subjected to heat and pressure to cure the compound and bond the heat-sealable adhesive firmly thereto.

9 Claims, No Drawings

SPLICEABLE SHEET MATERIAL

This is a division of application Ser. No. 592,620 filed Mar. 23, 1984, now abandoned.

BACKGROUND OF THE INVENTION

This invention relates to the sealing of overlapped rubbery olefinic polymer (i.e., homopolymer, copolymer, terpolymer, etc.) sheets to each other, to spliceable sheets, to a method of making such sheets, and to a transfer tape having particular utility in the manufacture of the heat-sealable sheets.

Rubbery olefinic polymer sheet material finds widespread industrial use in applications where it is necessary to contain or exclude liquids. Compared to vinyl sheet material, the rubbery olefinic polymer sheet materials have longer life, greater flexibility and resilience at low temperatures, ability to withstand high temperatures without stretching or softening unduly, and superior resistance to ultraviolet light. The most widely used rubbers for formulating these sheets are polymers of ethylene, propylene, and diene monomers (commonly known as EPDM), butyl rubber, and blends of the two. In making rubbery sheet material, the olefinic polymers are commonly blended with desired fillers, coloring agents, extenders, vulcanizing or crosslinking agents, antioxidants, etc. to form a "compound", which is then calendered or extruded into sheets (commonly known as "membranes"), typically on the order of 1.5 millimeters thick and 2 to 6 meters wide. These membranes are then heated to perhaps 150° C. for 2 hours to effect vulcanization.

For many of the applications in which rubbery membranes are employed, it is necessary to overlap and splice the edges of a large number of sheets. Rubbers, which have low energy surfaces, are unreceptive to many adhesives. Accordingly the splicing procedure has heretofore typically involved the steps of cleaning the overlapped areas, applying a primer solution to each face, allowing the solvent to evaporate, applying a contact adhesive solution to each face, again allowing the solvent to evaporate to leave a tacky adhesive surface, mating the contact adhesive-coated surfaces, and compacting the spliced area with a heavy steel roller. Operating in this way, it is possible to form extremely large spliced membranes which can be used to line water reservoirs, irrigation canals, sewage lagoons, industrial waste pits, and solar energy ponds; such products are popularly designated "geomembranes". The splicing process is, however, extremely labor-intensive and costly.

Another important application for spliced rubbery membranes is in the installation of flat roofs for commercial, institutional, and industrial buildings. Spliced membranes are laid over new or existing roofs and typically either fastened down (e.g., at 40-centimeter intervals) with metal battens or ballasted with round river-washed stones. When employed on a roof, extremely rigorous demands are placed on the rubbery membranes, particularly on the splices. Roof temperatures may approach the boiling point of water when exposed to the summer sun, and they may sink to −30° C.—or even lower—during the winter.

In all of the applications for spliced membranes just described, the splicing has been a tedious and time-consuming part of fabrication. How to simplify the preparation of lapped splices has remained an unsolved problem.

BRIEF DESCRIPTION OF THE INVENTION

The present invention provides an easy, simple, rapid, and effective technique for splicing rubbery membranes to form larger membranes. The resultant splices are strong, resistant to temperature extremes, and able to withstand the expansion and contraction that results from exposure to summer and winter conditions, all the while maintaining a water-tight seal.

One aspect of the invention relates to spliceable sheet material having particular utility in the fabrication of lapped-seam membrane roofing, comprising in combination a rubbery water-impermeable membrane consisting essentially of thermoset olefinic polymer having on one side, at least in a border area along one edge, a thin layer of firmly bonded heat-sealable adhesive of a type that wets the membrane. A presently preferred material for the rubbery olefin polymer membrane is EPDM, and a presently preferred adhesive is linear low density polyethylene having a softening point (as defined in ASTM Test D-816, Procedure 19) of at least 80° C., preferably 100° C., and most preferably at least 120° C. (It should be recognized that the term "polyethylene" may include the normally employed stabilizers, filers, extenders, processing aids, pigments, and the like.) Other suitable adhesives can be formulated from thermoplastic blends of polyethylene and polypropylene, homopolymers of olefin monomers, polymers of two or more olefin monomers, etc., provided that the softening point meets the stated temperature requirement. To enhance processability, the melt index of the adhesive is desirably at least 0.5, a melt index of about 1 being presently preferred. For convenience in use, the softening point of the heat-sealable adhesive should not exceed 250° C., and preferably is significantly lower, to minimize the possibility of degrading the rubbery membrane.

A presently preferred spliceable sheet material of the type described in the preceding paragraph is one in which linear low density polyethylene is adhered to the border area on one side of the rubbery sheet material adjacent a lateral edge and also on the border area on the other side adjacent the opposite lateral edge, this arrangement lending itself to a natural shingling type of overlapping.

A simple but unique transfer tape having particular utility in making the spliceable border areas of the sheet material just described comprises a release liner having strippably adhered to one face a thin layer of heat-sealable adhesive. A preferred transfer tape construction comprises a polyester film release liner, e.g., biaxially oriented polyethylene terephthalate, carrying a heat-sealable thermoplastic polyolefin layer, e.g., linear low density polyethylene. Spliceable rubbery sheet material may then conveniently be fabricated by placing the adhesive surface of the transfer tape in contact with the appropriate area or areas of the rubbery membrane and applying sufficient heat and pressure to melt the adhesive and bond it to the membrane. A particularly preferred method is to place the transfer tape in contact with the unvulcanized sheet material, apply sufficient pressure to maintain intimate contact between the tape material and heat the assembly to a temperature high enough to vulcanize (i.e., crosslink, or thermoset) the olefin polymer and, at the same time, soften the adhesive, thereby permitting it to wet and upon cooling, bond firmly to the olefinic polymer sheet. The release liner may then remain in place to protect the adhesive from contamination and be removed at the time a splice is to be made.

Because it is difficult, expensive, and time-consuming to conduct field evaluations of products made in accordance with the invention, a number of tests have been developed to provide information that relates directly to some aspect of roofing end use requirements. These tests, which incorporate built-in safety factors, are briefly described below.

1. T-Peel Test. In this test, two 2.54-cm wide × 15-cm long × 1.14-mm thick strips of commercially available EPDM-based membrane, each provided with a 38-micrometer layer of heat-activatable adhesive, are superposed in coextensive adhesive-to-adhesive contact and approximately 5 cm at one end laminated for one minute in a press at 160° C. and 20 kPa. Conventional T-peel tests are then performed in tensile testing equipment in which the jaws are separated at a rate of 30.5 cm/minute. For roofing applications, initial values should be at least 8.8 N/cm when tested at room temperature. After being subjected to any one of the conditions described below and then re-tested, T-peel values should be at least 17.5 N/cm.

a. Temperature Cycling. T-peel samples are exposed to room temperature for one week, −18° C. for one week, room temperature for another week, −18° C. for one week, and then tested.
b. Hot Water Immersion. Two hours after being prepared, T-peel samples are immersed for 24 hours in 70° C. water, removed, dried, and tested at room temperature.
c. Delayed Hot Water Immersion. 24 hours after being prepared, the T-peel samples are immersed in 70° C. water for 24 hours, removed, and tested as in sub-paragraph "b".
d. High Humidity. T-peel samples are exposed to 38° C. and 100% relative humidity for one week, removed, dried, and tested at room temperature.
e. Heat Aging. Samples are placed in a 70° C. oven for one week, removed, and tested at room temperature.
f. Heat Resistance. T-peel samples are heated as in sub-paragraph "e" but tested at 70° C.
g. Weather Resistance. Samples are exposed to the artificial weathering conditions provided by a "Weatherometer" machine in accordance with ASTM Test D-750. Tests are performed after 250 and 500 hours.
h. Freeze-Thaw Resistance. T-peel samples are immersed in room temperature water for one week and then placed in a −18° C. freezer for one week. They are removed and tested at room temperature.

2. Softening Point. Strips of the heat-sealable roofing membrane 2.54 cm wide are overlapped 2.54 cm adjacent one end of each and bonded for one minute, adhesive-to-adhesive, in a 160° C. press at a pressure of 20 kPa. The spliced strip is then removed and tested in accordance with a modified form of ASTM-D816 Procedure 19. In this test, the end of one strip is gripped between the jaws of a holder, the remainder of the spliced strip extending vertically, with a 2.27-kg weight attached to the free end. The assembly is then placed in a 65° C. oven and the temperature raised 0.5° C./minute until failure occurs; the acceptable threshold temperature is 120° C.

3. Dynamic Shear. Samples, prepared as in the softening point test, are mounted in a tensile testing machine, the jaws of which are separated at the rate of 1.3 mm/minute until failure occurs. A force of 275 kPa or more is considered acceptable.

4. Static Shear. Lap-spliced samples are prepared as in the preceding two tests. One end of the spliced sample is gripped in the jaws of a holder, with the remainder of the sample extending vertically. To the free end is then attached a 2.27-kg weight and the assembly placed in an 82° C. oven. Failure should not occur in less than 24 hours.

5. Low Temperature Flexibility. Two 2.54 cm × 12.5 cm strips of heat-sealable roofing membrane are superposed in adhesive-to-adhesive contact and bonded in a 160° C. press under a pressure of 20 kPa for one minute. The resulting laminate is conditioned in a freezer maintained at −34° C. for 24 hours. An operator, wearing gloves to avoid heating the samples, then bends the sample around a 1.27-cm. diameter refrigerated steel rod, removes it, and bends it in the opposite direction around the rod, repeating the cycle five times. No evidence of delamination should occur.

DETAILED DESCRIPTION

The invention will now be described with the aid of illustrative but non-limiting examples, in which all parts and percentages are by weight unless otherwise indicated.

EXAMPLE 1

A linear low density polyethylene (Union Carbide "G-Resin 7047 Natural 7"), having a melt index of 1.0, was extruded through a slot die having an opening of 0.56 mm at a die head temperature of 250° C. Immediately after emerging from the die, the extruded polyethylene film was contacted by a 38-micrometer polyester film; the resulting laminate was pulled between a rubber roll and metal roll, located approximately 75 mm from the die opening. The rolls were driven at a considerably faster surface speed than the rate at which the polyethylene was extruded, so that the polyethylene thickness was reduced to approximately 90 micrometers. Samples approximately 75 mm × 100 mm were then cut from the laminate and used for further testing. The polyethylene was tack-free at room temperature.

A sample of the laminate was positioned with the polyethylene layer against a smooth sheet of 1.5-mm cured EPDM rubber, and placed for 30 seconds in a press heated to 218° C. under a pressure of approximately 35 kPa. The sample was then removed from the press and allowed to cool to room temperature, after which the polyester release liner was stripped away, exposing the heat-sealable polyethylene surface. The stripping force required was about 0.03 N/cm width. Values of at least about 0.02 N/cm are desirable for ease in processing, values somewhat in excess of 0.1 N/cm being satisfactory but not preferred. Significantly higher stripping values make the product more difficult for the end user to remove the release liner.

EXAMPLE 2

A polyethylene-polypropylene blend (Eastman Chemical Company "Tenite" 5321E polyallomer) was extruded through a 0.38-mm 240° C. die head and processed as in Example 1.

The adhesive-coated EPDM products made in accordance with the preceding examples were then tested in accordance with the previously described procedures. Results are tabulated below:

TABLE I

| Test | Acceptable | Example 1 | Example 2 |
|---|---|---|---|
| 1. T-Peel, N/cm | | | |
| a. Initial | 8.8 | 35* | 35* |
| b. Temperature Cycling | 17.5 | 35* | 35* |
| c. Hot Water Immersion | 17.5 | 35* | 35* |
| d. Delayed Hot Water Immersion | 17.5 | 35* | 35* |
| e. High Humidity | 17.5 | 35* | 35* |
| f. Heat aging | 17.5 | 35* | 35* |
| g. Heat Resistance | 17.5 | 35* | 35* |
| h. Weather Resistance | 17.5 | 35* | 35* |
| i. Freeze-Thaw Resistance | 17.5 | 35* | 35* |
| 2. Softening Point, °C. | ≧120 | 127* | 162* |
| 3. Dynamic Shear, kPa | 275 | 353* | 353* |
| 4. Static Shear, Hours | ≧24 | 168 | 168 |
| 5. Low Temperature Flexibility | No delamination | No delamination | No delamination |

*Failure occurred within the rubber, the splice remaining intact.

In factory production operations, it has been found convenient to apply the linered heat-sealable adhesive directly to the uncured EPDM rubber membrane in 5.0–7.5-cm strips along the border of one side adjacent the edge. The assembly is then subjected to 375 kPa pressure at 150° C. to cure the EPDM rubber and simultaneously bond the heat-sealable adhesive firmly thereto. Workers in the field lay out the rubber membrane in a manner such that the heat-sealable portion of one strip of material overlaps the edge of an ajacent strip of material, after which they remove the liner. Heat is then applied, either directly to the adhesive or to the opposite side of the adhesive-bearing rubber membrane in the splice area, to soften the adhesive and cause it to bond firmly to the underlying edge of the adjacent strip.

In circumstances where the rubber membrane has an embossed or irregular surface, adhesion in the splice area will be enhanced if confronting border portions of the overlapped strips are both provided with a heat-sealable coating. This construction can be achieved during factory production by making sure that a first heat-sealable transfer tape is positioned on one side adjacent one edge and a second heat-sealable transfer tape is positioned on the other side adjacent the second edge.

In some circumstances, it may be advantageous to coat one entire side of the rubber membrane with heat-sealable coating. With completely coated membranes of this type, rolls of the membrane may be slit to any desired width, e.g., to fit narrow portions of a roof, while still maintaining heat-sealable coating adjacent each edge. Another advantage achieved by overall coating with heat-sealable adhesive is the ability to seal directly to the upper surface of batten strips that have been nailed or otherwise affixed to the roof substrate, thereby permitting completely imperforate roofing membrane construction. For such purposes, it is advantageous to use batten strips made of polyethylene, which are not only moisture- and rust-resistant but also inherently possess heat-sealable properties and are compatible with the thermoplastic olefinic heat-sealable coating on the roofing membrane. If, of course, the polyethylene batten strips are used only in the spliced areas, it is adequate to have heat-sealable adhesive only in the border area of the lower membrane, where it will contact the batten strip.

It will be appreciated that varying the composition of the rubber membrane may make it desirable to modify the heat-sealable adhesive composition. Also, as indicated earlier in the discussion of this invention, the performance requirements for roof construction are somewhat more strenuous than may be required for such other applications as pond or swimming pool liners; for such uses, other heat-sealable adhesives should be able to perform effectively. Those skilled in the art will, however, have no difficulty in determining suitable adhesives to be employed in appropriate circumstances, considering the foregoing discussion.

I claim:

1. A spliceable sheet material for use in the fabrication of lapped-seam membrane roofing, comprising in combination:

a rubbery water-impermeable membrane consisting essentially of thermoset olefin polymer, said membrane having on one side, in a border area along one edge, a thin layer of firmly bonded heat-sealable high molecular weight, thermoplastic adhesive that wets the thermoset olefin polyolefin polymer and that has a softening point of at least about 80° C. and less than about 250° C., said heat-sealable adhesive having a melt index of at least 0.5, said membrane also having on the opposite side in a border area along the opposite edge, a thin layer of the same adhesive, whereby when splicing is effected by overlapping adjacent strips of said sheet material so that the adhesive-coated surfaces are in contact and heat and pressure is applied to the overlapped area, the T-peel values of the spliced borders are at least 17.5 N/cm, the dynamic shear is at least 17.5 N/cm, the static shear is at least 24 hours, and the low temperature flexibility requirements are satisfactory, all as measured in accordance with the tests described herein.

2. The sheet material of claim 1 wherein the heat-sealable adhesive has a softening point of at least 100° C.

3. The sheet material of claim 1 wherein the heat-sealable adhesive has a softening point of at least 120° C. but not more than 250° C.

4. The sheet material of claim 3 wherein the olefin polymer consists essentially of polymerized ethylene, propylene, and diene monomers (EPDM).

5. The sheet material of claim 4 wherein the heat-sealable adhesive is linear low density polyethylene having a melt index of about 1.0.

6. The sheet material of claim 1 wherein the heat-sealable adhesive is protectively covered by a strippable liner.

7. A spliced membrane made by overlapping the adjacent borders of two laterally juxtaposed strips of the sheet material of claim 1, so that the adhesive is interposed between the two thermoset olefin adhesive-coated surfaces are in contact with each other, and applying sufficient heat and pressure to bond the overlapped borders to each other.

8. The spliced membrane of claim 7 wherein the softening point is at least 120° C.

9. The sheet material of claim 1 wherein the layer of heat-sealable adhesive is about 90 micrometers thick.

* * * * *